US005341664A

United States Patent [19]

Noé et al.

[11] Patent Number: 5,341,664

[45] Date of Patent: Aug. 30, 1994

[54] ROLL SET FOR THIN METAL STRIP

[75] Inventors: Rolf Noé; Andreas Noé, both of Mülheim, Fed. Rep. of Germany

[73] Assignee: BWG Bergwerk- und Walzwerk-Maschinenbau GmbH, Duisburg, Fed. Rep. of Germany

[21] Appl. No.: 92,230

[22] Filed: Jul. 14, 1993

[30] Foreign Application Priority Data

Sep. 10, 1992 [DE] Fed. Rep. of Germany ..... 4230243

[51] Int. Cl.[5] ..... B21B 39/08

[52] U.S. Cl. ..... 72/161; 72/205; 72/176; 492/4

[58] Field of Search ..... 72/160, 161, 164, 199, 72/205, 252.5, 176, 177; 492/4

[56] References Cited

U.S. PATENT DOCUMENTS

| | | | |
|---|---|---|---|
| 1,943,005 | 1/1934 | Coryell | 72/205 |
| 2,219,665 | 10/1940 | Simons | 72/205 |
| 3,535,902 | 10/1970 | Sevenich et al. | 72/161 |
| 4,593,548 | 6/1986 | Hashimoto et al. | 72/161 |

*Primary Examiner*—Lowell A. Larson
*Assistant Examiner*—Thomas C. Schoeffler
*Attorney, Agent, or Firm*—Herbert Dubno

[57] ABSTRACT

The bridle or bridles of a stretching or levelling line for a thin metal strip, e.g. of a thickness of up to 1 mm, can have at least one roll of a periphery variable between an outwardly convex and an inwardly concave bulge to compensate for dishing of the strip or edge waviness.

14 Claims, 3 Drawing Sheets

ROLL SET FOR THIN METAL STRIP

FIELD OF THE INVENTION

The present invention relates to a roll set or bridle for thin metal strip, i.e. metal stripping having a thickness up to 1 mm. More particularly this invention relates to an apparatus used in the handling of thin metal strip which includes a pair of rollers, frequently referred to as a bridle, about which the strip passes in a S-pattern and to apparatuses embodying a roll bridle and possibly two or more roll bridles in conjunction with the levelling or flattening of the strip.

BACKGROUND OF THE INVENTION

For the levelling or flattening of the metal strip, various straightening processes are Used, e.g. stretch or tension straightening, tension levelling, stretcher levelling and stretch-bend levelling.

Generally, these straightening or levelling processes are carried out continuously and, although the levelling process has been greatly improved in recent years, even today, it is necessary to tolerate slight central dishing of the strip or edge corrugation following the straightening, flattening or levelling process. The residual lack of planarity results from the nonuniform transverse stresses distributed over the width of the strip and which are superimposed on the tensile stresses in the longitudinal direction of the strip. The smaller the strip thickness and the modulus of elasticity of the strip, the greater is the risk of residual lack of planarity. The same applies to cold rolling of metal strip, especially for the after-rolling or dressing or final rolling stages. Because of the bending of the rolls, as a result of the rolling force, and because the incoming thickness profile of the metal strip is as a rule not truly rectangular, nonuniform deformations can arise in the rolling gap or nip of the rolling mill over the width of the strip, leading to corrugation or waviness in the strip following cold rolling.

As a result, it has been the practice to try to correct the roll gap geometry to eliminate the corrugation or waviness. These efforts, however, have proven to be unsuccessful or insufficient. It appears that the deformation that occurs in the rolling gap does not depend exclusively on the rolling force distribution but is also a function of the tensile stress distribution over the width of the strip. That distribution could not be readily modified heretofore.

OBJECTS OF THE INVENTION

It is therefore an object of the present invention to provide a roll set, especially a bridle over which the strip passes in an S-pattern, so that in conjunction with the levelling or flattening of a metal strip, especially a thin metal strip, both the edge waviness and central dishing of the strip can be significantly reduced and even eliminated in many cases.

Another object of the invention is to provide an improved levelling or flattening system for thin metal strip whereby drawbacks of earlier systems are obviated.

It is also an object of the invention to flatten or level metal strip and especially metal strip having a thickness up to 1 mm utilizing at least one bridle over which the strip passes in an S-pattern.

SUMMARY OF THE INVENTION

These objects and others which will become apparent hereinafter are attained, in accordance with the invention by providing an apparatus which has at least one bridle over which the strip passes and around which the strip is looped in an S-pattern so that at least one of the rolls of the bridle can have its periphery selectively deformed between an outwardly convex bulge and an inwardly concave bulge, while the respective metal strip passes around the adjustable-periphery roll with a predetermined looping angle or arc.

More particularly, a roller bridle for metal strip having a thickness up to 1 mm can comprise a pair of rolls over which said metal strip passes in an S pattern, at least one of said rolls having a rotatable support, a flexible periphery with which said metal strip is in contact over a given wrapping angle, and means for imparting to said periphery a selected deformation ranging between an outwardly convex and an inwardly concave bulge.

According to the invention, when a thin metal strip passes continuously through the bridle of the invention and a convex bulge is imparted to the variable-periphery roll of the bridle, a tensile stress concentration is effected in the center of the strip. By contrast, with a concave inner bulge, a tensile strength concentration is effected along the edges of the strip. At the locations of the tensile stress concentration, there is a locally higher plastic deformation. As a result, edge waviness or corrugation and central dishing which can arise in the strip because of different degrees of stretch across the strip width and the different lengths of individual strip zones, can be reduced or completely eliminated.

With a convex outward bulging or curvature of the roll, the center of the strip is stretched to a greater extent and in this manner edge waviness can be eliminated. With a concave inwardly bulging of the roll, the edges of the strip are more highly stretched to compensate transverse stretch stresses which increase from the strip edges toward the center of the strip. The central region of the strip and edge regions are thus stressed to similar degrees and a central dishing can be eliminated.

The tensile strength which is applied during the flattening and levelling prevents excessive stretch in either of the central or edge regions and thus both the dishing and the edge waviness can be eliminated.

According to a feature of the invention which is of independent inventive significance, two bridles or pairs of rolls are provided and the web is looped in an S-pattern around the rolls of both bridles. Along the stretch of strip between the bridles, the strip is subjected to tension and can be levelled or flattened, e.g. by a cold rolling mill or an array of stretch bend levelling rollers.

Each bridle may have a drive for the downstream roller and a brake for the upstream roller or the strip may be simply pulled through the upstream roller of the bridle braked to a greater degree than any braking applied to the downstream roller.

These systems have been found to be especially effective in the flattening of metal strip which is intended for use in lithography. Where surface distortion is to be avoided, as in this case, the strip can simply be flattened by displacing it through the two bridles without the cold rolling mill or the array of stretch-bend rollers. A surface free from distortion is particularly important for the lithographic strip.

When the cold roll stand and/or the array of stretch bend rollers are provided along a stretch of the strip between the upstream and downstream bridles, at least the rolls of the bridle proximal to the aforementioned stretch, i.e. directly upstream and downstream of the latter, are provided with the adjustable periphery capable of adjustment between the outwardly convex bulge and inwardly concave bulge. In this case, the effects obtained are similar to those with cold rolling and stretch bend flattening but with elimination of the central dishing and the edge waviness.

The concentration of the tensile stresses either in the central region of the strip or in the edge regions of the strip, as a consequence of a higher plastic deformation with a higher degree of stretch are able, not only during dimension levelling but also during stretch bend flattening, to operate with a greater thickness reduction during cold rolling to eliminate edge waviness and central dishing.

According to another feature of the invention, all of the rollers of the bridle or bridles can be equipped so as to have their peripheries deformed between convex and concave peripheries. The rolls of the bridle can be arranged one above another in a vertical position or with one adjacent the other in a generally horizontal orientation.

To insure a high degree of plastic deformation in the central or edge regions of the strip, the roll diameter of each of the adjustable periphery bridle rolls can have a diameter of at least 250 mm while the looping angle of the strip about each bridle roll is at least 90° and preferably is greater than 150°.

According to a feature of the invention, the means for adjusting the periphery of the bridle roll can include a pressurizable chamber within the roll between the roll core and a peripheral shell and which can be supplied with a hydraulic or pneumatic fluid pressure medium. Upon pressure relief, the shell can assume an outwardly concave configuration. The configuration can be effected by a negative grinding of the peripheral shell which can be unitary with the remainder of the roll.

The core can have two stub shafts at opposite axial ends by means of which the roll is mounted in the usual journals and an axial bore or passage in one of these shafts can be connected to the chamber to supply a pressurizable fluid thereto. A venting bore can be provided at least temporarily for the chamber to allow, for example, the chamber to be filled with the pressurizable fluid.

By appropriate selection of the inner contour of the roll shell, upon pressurization of the chamber it is possible to obtain a parabolical shape of the periphery. The negative grinding can provide a paraboloidal inward bulge such that the bulging to either side of the cylindrical shape can be readily effected in a positive or negative sense. The venting bore is only required for the initial filling of the pressurizable chamber.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
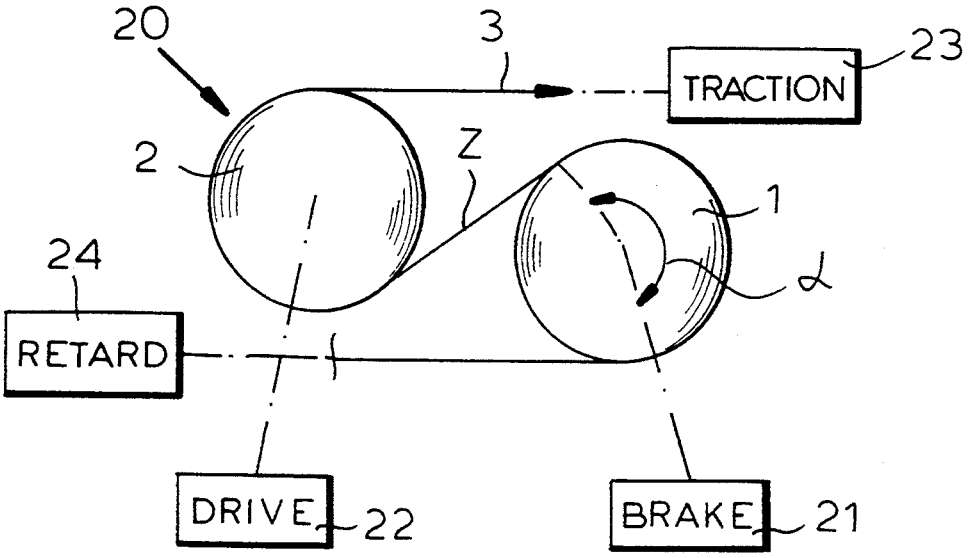
FIG. 1 is a diagrammatic side elevational view of a pair of bridle rolls defining a flattening stretch between them.

From the drawing, it can be seen that the basic element of the view is a bridle generally represented at 20 which comprises two rolls 1, 2, referred to as looping rolls or deflection rolls, about which the thin metal strip 3 is looped in an S-shaped pattern. As can be seen from this Figure, a stretching zone Z may be provided between the upstream roll 1 and the downstream roll 3 and the stretching force may be provided by applying a brake 21 to the upstream roll 1 and either driving the downstream roll 2 with a drive 22 or applying traction as represented at 23 via other rolls to the strip. An alternative to braking the upstream roll 1 is to apply a retardation force to the strip 3 as represented at 24, upstream of that roll 1. The traction may be applied by another bridle roll pair and the retardation may be applied by another bridle roll pair. The angle of looping is represented at alpha in FIG. 1 and is approximately 225°. Looping angles are in excess of 90° and preferably in excess of 150°.

The meter strip can have a width in excess of 800 mm and a thickness of up to 1 mm and especially can be metal strip utilized in the lithographic industry.

Figure 5A:
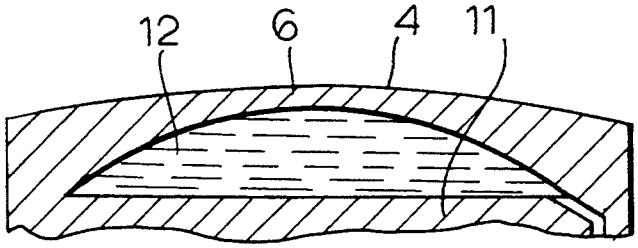
FIGS. 5*a*, 5*b* and 5*c* are figures in cross section and diagrammatically illustrating various configurations of the periphery and the working range between them.
Figure 5B:
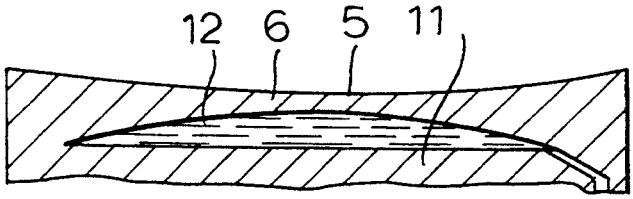

At least one of the looping rolls 1 or 2 and preferably both of them has a variable periphery which is selectively alterable from a convex bulge (FIG. 5*a*) to a concave bulge (FIG. 5*b*), the periphery being represented at 6.

Figure 2:
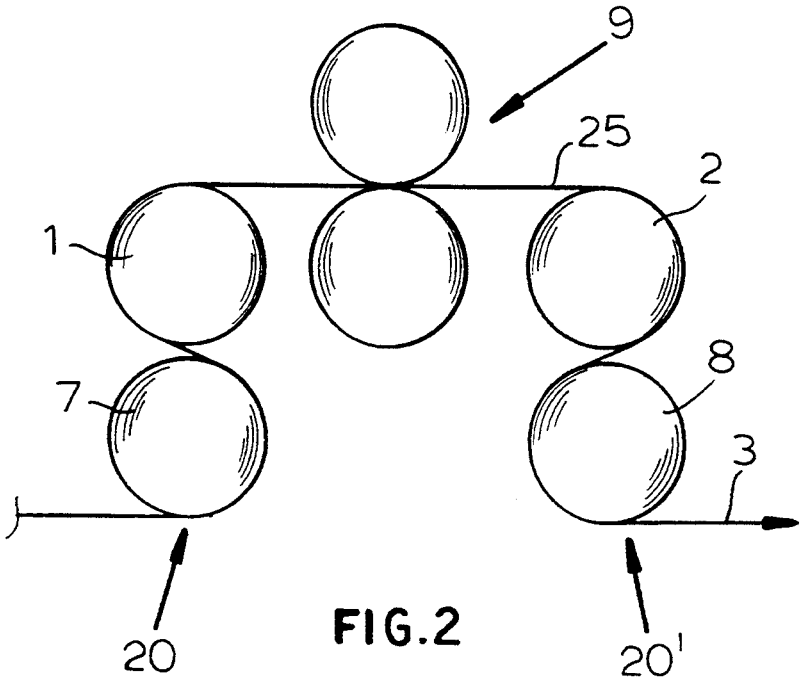
FIG. 2 is a similar illustration of an apparatus using two roll bridles with a cold rolling frame between them.
Figure 3:
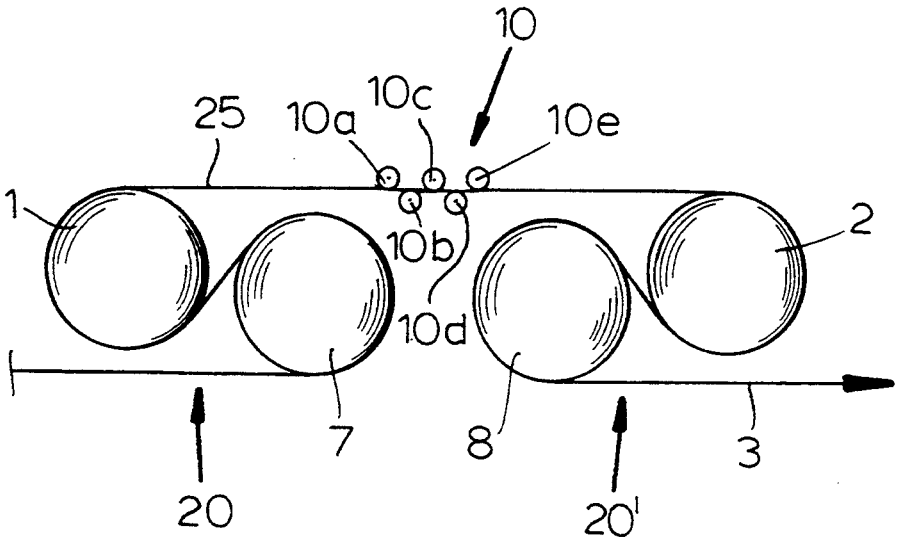
FIG. 3 is a view of a system in which two bridles have a stretch bending array of rollers between them.

As can be seen from FIGS. 2 and 3, 2 bridle roll pairs 20 and 20' can be provided on upstream and downstream sides of a horizontal stretch 25 of the strip 3 at which a cold rolling stand 9 or an array of stretching bending rolls 10 can be provided. The stretch bending rolls 10 include rolls 10*a*, 10*c* and 10*e* located on one side of the strip 3 with the rolls 10*b* and 10*d* staggered so as to lie on the opposite side in the spaces between the rolls 10*a* and 10*c* and the rolls 10*c* and 10*e*, respectively.

In the embodiments of FIGS. 2 and 3, the bridles 20 and 20' are shown to be vertically disposed and substantially horizontally disposed, respectively and the proximal rolls 1 and 2 to the stretch 25 at least are of the variable periphery described so that the periphery can be changed from an outwardly convex to an outwardly concave periphery and vice versa.

The diameters of at least the rolls 1 and 2 and preferably all of the rolls 1, 2, 7, 8 has a diameter of 250 mm in the cylindrical configuration of the variable periphery rolls and here as well the looping angle should exceed 90° and is preferably more than 150° to generate the sufficiently high plastic deformation in either the edge regions of the strip or in the central region of the strip that is desired.

Figure 4:
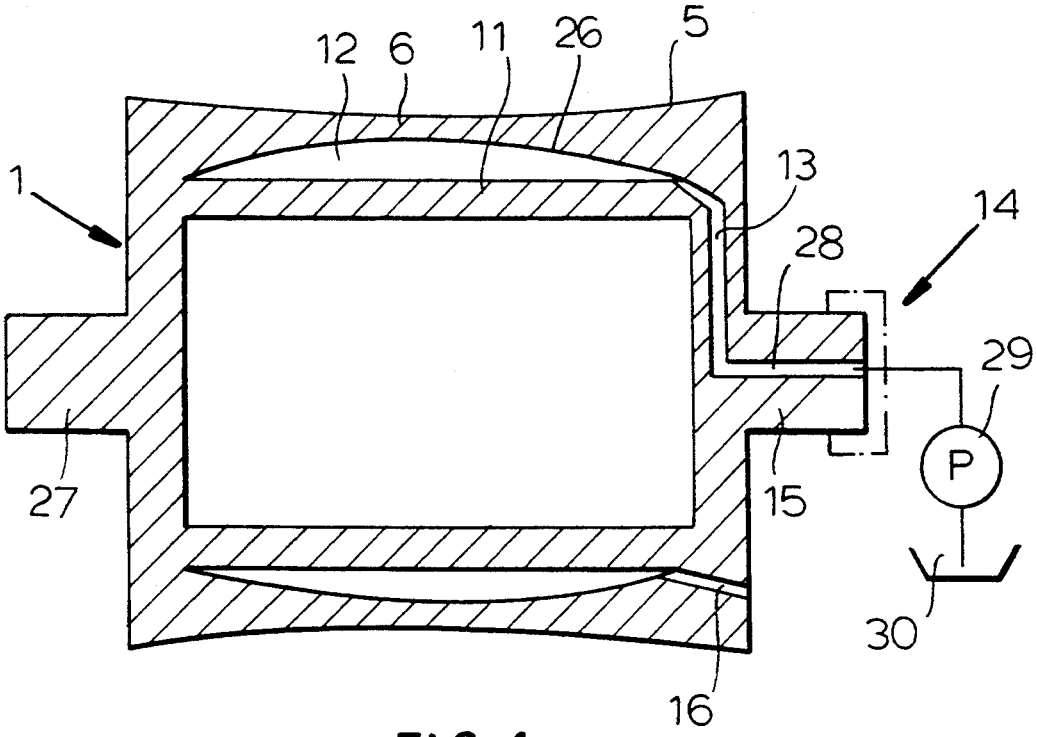
FIG. 4 is an axial cross sectional view through a roll according to the invention.

FIG. 4 shows, in highly diagrammatic form, a deflection or looping roll 1 of one of the bridles and which can have a convex to concave periphery 6. The periphery is formed on a shell 26 which is unitary with the roll core 11 forming a support from which stub shafts 15 and 27 project axially. Between this shell and the core 11 is a pressurizable chamber 12 connected by a passage 13 to an axial passage 28 in the stub shaft 15. The shafts 15 and 27 are received in journals represented diametrically at 14 which can be provided with a feeder for the pressurizable fluid. The pressurizable medium is drawn by a high pressure pump from a reservoir 30.

Figure 5C:
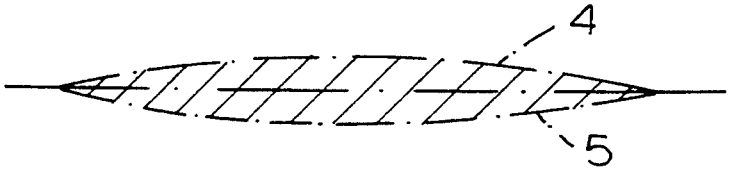

A vent passage 16 can be used for filling the chamber 12 and can then be closed by an appropriate plug or the like for pressurization. As is apparent from FIGS. 4 and 5*b*, in the depressurized state of the chamber 12 the periphery 5 has a concave contour as represented at 5 and the periphery has a convex contour 4 when liquid in the chamber 12 is pressurized. The range of variation of the periphery of the roll has been illustrated in FIG. 5*c*. It will be apparent that all of the rolls 1, 2, 7 and 8 can be of similarly variable periphery.

We claim:

1. A roller bridle for metal strip having a thickness up to 1 mm, comprising a pair of rolls over which said metal strip passes in an S pattern, at least one of said rolls having a rotatable support, a flexible periphery with which said metal strip is in contact over a given wrapping angle, and means for imparting to said periphery a selected deformation ranging between an outwardly convex and an inwardly concave bulge.

2. The roller bridle defined in claim 1 wherein said rolls form a strip tensioning set, further comprising means connected to at least one of said rolls for stretching said strip over a stretching span between said rolls.

3. The roller bridle defined in claim 1 wherein a second pair of rolls about which said strip is looped in an S pattern is spaced from said first-mentioned pair by a stretch of said strip, further comprising a cold-rolling stand along said stretch, at least the rolls of said pair immediately upstream and downstream of said cold-rolling stand having respective rotatable supports, respective flexible peripheries with which said metal strip is in contact over a given wrapping angle, and means for imparting to said peripheries a selected deformation ranging between an outwardly convex and an inwardly concave bulge.

4. The roller bridle defined in claim 3, wherein each of the rolls of each of said pairs have respective rotatable supports, respective flexible peripheries with which said metal strip is in contact over a given wrapping angle, and means for imparting to said peripheries a selected deformation ranging between an outwardly convex and an inwardly concave bulge.

5. The roller bridle defined in claim 1 wherein a second pair of rolls about which said strip is looped in an S pattern is spaced from said first-mentioned pair by a stretch of said strip, further comprising an array of stretcher leveling rollers along said stretch, at least the rolls of said pair immediately upstream and downstream of said array having respective rotatable supports, respective flexible peripheries with which said metal strip is in contact over a given wrapping angle, and means for imparting to said peripheries a selected deformation ranging between an outwardly convex and an inwardly concave bulge.

6. The roller bridle defined in claim 5, wherein each of the rolls of each of said pairs have respective rotatable supports, respective flexible peripheries with which said metal strip is in contact over a given wrapping angle, and means for imparting to said peripheries a selected deformation ranging between an outwardly convex and an inwardly concave bulge.

7. The roller bridle defined in claim 1, wherein both of the rolls of said pair have respective rotatable supports, respective flexible peripheries with which said metal strip is in contact over a given wrapping angle, and means for imparting to said peripheries a selected deformation ranging between an outwardly convex and an inwardly concave bulge.

8. The roller bridle defined in claim 1 wherein said rolls are spaced one above another vertically.

9. The roller bridle defined in claim 1 wherein said rolls are spaced one alongside the other horizontally.

10. The roller bridle defined in claim 1 wherein the roll diameter of said one of said rolls is at least 250 mm.

11. The roller bridle defined in claim 1 wherein the wrapping angle with which said strip is looped around said rolls is at least 90°.

12. The roller bridle defined in claim 11 wherein the wrapping angle with which said strip is looped around said rolls is at least 150°.

13. The roller bridle defined in claim 1 wherein said support is a roll core, said periphery is formed by a flexible roll shell defining an expandable and contractible chamber with said core, and said means for imparting a selected deformation includes means for feeding a pressurizable fluid medium to said chamber, said shell having an outwardly concave configuration upon depressurization of said chamber.

14. The roller bridle defined in claim 13 wherein said core has a pair of stub shafts at opposite ends thereof for journaling said one of said rolls for rotation about an axis of said core, said means for feeding including an axial passage in one of said stub shafts, said one of said rolls further comprising means forming a venting bore enabling filling of said chamber with said medium.

* * * * *